US009708563B2

(12) United States Patent
Crawley et al.

(10) Patent No.: US 9,708,563 B2
(45) Date of Patent: Jul. 18, 2017

(54) LUBRICATING COMPOSITION CONTAINING AN ANTIWEAR AGENT

(71) Applicant: The Lubrizol Corporation, Wickliffe, OH (US)

(72) Inventors: Seth L. Crawley, Mentor, OH (US); Jody A. Kocsis, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/729,896

(22) Filed: Jun. 3, 2015

(65) Prior Publication Data

US 2015/0267140 A1 Sep. 24, 2015

Related U.S. Application Data

(63) Continuation of application No. 13/514,102, filed as application No. PCT/US2010/059809 on Dec. 10, 2010, now abandoned.

(60) Provisional application No. 61/286,109, filed on Dec. 14, 2009.

(51) Int. Cl.

*C10M 141/06* (2006.01)
*C10M 141/08* (2006.01)
*C10M 163/00* (2006.01)

(52) U.S. Cl.

CPC ..... *C10M 141/06* (2013.01); *C10M 141/08* (2013.01); *C10M 163/00* (2013.01); *C10M 2207/028* (2013.01); *C10M 2207/042* (2013.01); *C10M 2207/128* (2013.01); *C10M 2207/26* (2013.01); *C10M 2207/262* (2013.01); *C10M 2207/281* (2013.01); *C10M 2207/34* (2013.01); *C10M 2215/04* (2013.01); *C10M 2215/082* (2013.01); *C10M 2215/16* (2013.01); *C10M 2215/26* (2013.01); *C10M 2219/046* (2013.01); *C10M 2219/06* (2013.01); *C10M 2223/043* (2013.01); *C10M 2223/045* (2013.01); *C10N 2230/06* (2013.01); *C10N 2230/12* (2013.01); *C10N 2230/42* (2013.01); *C10N 2230/43* (2013.01); *C10N 2230/45* (2013.01); *C10N 2240/10* (2013.01); *C10N 2240/102* (2013.01); *C10N 2240/104* (2013.01)

(58) Field of Classification Search

CPC ..... C10M 163/00; C10M 141/06; C10M 2215/086; C10M 2215/16; C10M 141/08; C10M 2207/028; C10M 2207/042; C10M 2207/128; C10M 2207/26; C10M 2207/262; C10M 2207/281; C10M 2207/34; C10M 2215/04; C10M 2215/082; C10M 2215/26; C10M 2219/046; C10M 2219/06; C10M 2223/043; C10M 2223/045; C10N 2230/06; C10N 2230/12; C10N 2230/42; C10N 2230/43; C10N 2230/45; C10N 2240/10; C10N 2240/102; C10N 2240/104

USPC ..... 508/447, 507

See application file for complete search history.

(56) References Cited

U.S. PATENT DOCUMENTS

| | | | | |
|---|---|---|---|---|
| 2,053,045 | A * | 9/1936 | Harwood | C10M 1/08 508/447 |
| 2,363,513 | A | 11/1944 | Farrington et al. | |
| 2,628,941 | A | 2/1953 | Adelson et al. | |
| 3,127,349 | A | 3/1964 | Rockett et al. | |
| 3,366,569 | A | 1/1968 | Norman et al. | |
| 3,896,050 | A | 7/1975 | White et al. | |
| 4,012,408 | A | 3/1977 | White et al. | |
| 4,025,446 | A | 5/1977 | Cier et al. | |
| 4,031,015 | A | 6/1977 | Miller et al. | |
| 4,058,469 | A | 11/1977 | Hoke et al. | |
| 4,209,408 | A | 6/1980 | Hoke et al. | |
| 4,237,022 | A | 12/1980 | Barrer et al. | |
| 4,569,777 | A | 2/1986 | Miller et al. | |
| 5,298,565 | A * | 3/1994 | Lange | C08F 255/00 508/264 |
| 5,338,470 | A | 8/1994 | Hiebert et al. | |
| 2005/0184466 | A1* | 8/2005 | Yoshida | F16J 9/206 277/468 |
| 2006/0079413 | A1* | 4/2006 | Kocsis | C10M 129/72 508/287 |
| 2006/0183652 | A1 | 8/2006 | Fujitsu et al. | |
| 2006/0189489 | A1 | 8/2006 | Fujitsu et al. | |

FOREIGN PATENT DOCUMENTS

| | | |
|---|---|---|
| CA | 1183125 | 2/1985 |
| GB | 1538889 | 1/1979 |
| WO | 2006044411 | 4/2006 |

* cited by examiner

*Primary Examiner* — James Goloboy
(74) *Attorney, Agent, or Firm* — Christopher D. Hilker; David M. Shold; Teresan W. Gilbert

(57) ABSTRACT

The invention provides a lubricating composition containing an oil of lubricating viscosity, a compound derived from the hydroxy-carboxylic acid and a nitrile compound. The invention further relates to a method of the lubricating an internal combustion engine with the lubricating composition.

11 Claims, No Drawings

LUBRICATING COMPOSITION CONTAINING AN ANTIWEAR AGENT

FIELD OF INVENTION

The invention provides a lubricating composition containing an antiwear agent and an oil of lubricating viscosity. The invention further relates to the use of the lubricating composition in an internal combustion engine.

BACKGROUND OF THE INVENTION

It is well known for lubricating oils to contain a number of surface active additives (including antiwear agents, friction modifiers, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Other additives may also increase lead corrosion.

Further, engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

With increasing control of both the formation of sulphated ash and release of emissions (typically to reduce NOx formation, SOx formation) there is a desire towards reduced amounts of sulphur, phosphorus and sulphated ash in engine oils. Consequently, the amounts of phosphorus-containing antiwear agents such as ZDDP, overbased detergents such as calcium or magnesium sulphonates and phenates have been reduced. As a consequence, ashless additives such as esters of polyhydric alcohols or hydroxyl containing acids including glycerol monooleate and alkoxylated amines have been contemplated to provide friction performance. However there have been observations that ashless friction modifiers may in some instances increase corrosion of metal, namely, copper or lead. Copper and lead corrosion may be from bearings and other metal engine components derived from alloys using copper or lead. Consequently, there is a need to reduce the amount of corrosion caused by ashless additives. However, reducing the levels of antiwear and other ash-containing additives may result in increasing amounts of wear and/or copper corrosion.

U.S. Pat. No. 3,127,349 discloses a composition optionally containing a nitrile ester capable of increasing the viscosity index of an oil containing a viscosity index improver and attenuating viscosity index decrease over time.

U.S. Pat. No. 3,366,569 discloses a composition resulting from contacting an alkylene polyamine with a hydrocarbyl substituted acylating agent and a nitrile such as acrylonitrile. The composition provides detergency and rust protection.

U.S. Pat. No. 4,025,446 discloses the use of several poly-nitrile compounds as effective anti-wear agents.

U.S. Pat. No. 4,209,408 discloses a lubricating composition containing at least one polyfunctional sulphur-containing nitrile.

U.S. Pat. Nos. 4,012,408 and 3,896,050 disclose a copper corrosion inhibitor derived from a cyano-substituted isothiazole.

U.S. Pat. No. 4,031,015 discloses oil-soluble compositions containing the reaction product of an olefin with an α,β-unsaturated nitrile to form an organonitrile. The organonitrile is then reacted with an amine or polyamine.

British Patent GB 1 538 889 discloses a lubricating composition containing a nitrile compound having either (i) an aliphatic thioether group, or (ii) an aliphatic ether group.

U.S. Pat. No. 4,058,469 discloses the use of polyfunctional nitriles as effective seal swelling agents and demulsifiers.

U.S. Patent Application 2006/0189489 A1 discloses a lubricating composition containing base oil, glycerol monooleate, and one or more nitriles.

U.S. Patent Application 2006/183652 discloses a lubricating composition containing base oil, oleylamide, an ether and at least one nitrile.

Romanian journal publication Revistade Chimie (Bucharest, Romania) (1981), 32(7), 686-7 discloses motor oil containing 0.5 wt % to 1 wt % of four nitriles as corrosion inhibitors, extreme pressure agents or antiwear agents. The nitriles include dodecylnitrile, stearylnitrile, oleylnitrile, and mixed-nitrile derivatives of linseed oil.

Canadian Patent CA 1 183 125 discloses lubricants for gasoline engines containing alkyl-ester tartrates, where the sum of carbon atoms on the alkyl groups is at least 8. The tartrates are disclosed as antiwear agents. Other references disclosing tartrates and/or tartrimides include International Publication WO 2006/044411, and US Patent Applications for internal combustion engines requiring reduced amounts of sulphur, sulphated ash, and phosphorus. The lubricant composition has anti-wear or anti-fatigue properties. The lubricating compositions are suitable for road vehicles.

U.S. Pat. No. 4,237,022 discloses tartrimides useful as additives in lubricants and fuels for effective reduction in squeal and friction as well as improvement in fuel economy.

U.S. Pat. No. 5,338,470 and International Publication WO 2005/087904 disclose lubricants containing at least one hydroxycarboxylic acid ester or hydroxy polycarboxylic acid (in particular citrates). The lubricant composition has anti-wear or anti-fatigue properties.

International Application WO2008/070307 discloses engine lubricants containing antiwear agents based on malonate esters.

SUMMARY OF THE INVENTION

The inventors of this invention have discovered a lubricating composition that is capable of providing at least one of antiwear performance, friction modification (particularly for enhancing fuel economy), extreme pressure performance, or lead or copper (typically copper) corrosion inhibition.

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

In one embodiment the invention provides a lubricating composition comprising an oil of lubricating viscosity, a nitrile compound, and a compound which is a derivative of a hydroxy-carboxylic acid.

In one embodiment the invention provides a lubricating composition comprising an oil of lubricating viscosity, a compound which is a derivative of a hydroxy-carboxylic acid, and a nitrile compound having general formula $CH_3(CQW)_m—C{\equiv}N$, wherein m may be 2 to 50, or 5 to 30, or 7 to 22, or 10 to 18, and Q and W may independently be a hydrocarbon group (typically containing 1 to 20, or 1 to 10, or 2 to 8 carbon atoms), or hydrogen. In one embodiment Q and W are both hydrogen.

In one embodiment the invention provides a lubricating composition comprising an oil of lubricating viscosity, a compound which is a derivative of a hydroxy-carboxylic acid, and a nitrile compound having general formula $CH_3(CH_2)_m—C{\equiv}N$, wherein m may 7 to 22, or 10 to 18.

In one embodiment the compound derived from the hydroxy-carboxylic acid may be a derivative of tartaric acid, or mixtures thereof.

In one embodiment the invention provides a lubricating composition wherein the nitrile and the compound which is a derivative of a hydroxy-carboxylic acid may both be present in an amount in the range of:

(i) 0.01 wt % to 3 wt % and 0.01 wt % to 3 wt % respectively, or (ii) 0.05 wt % to 2 wt % and 0.05 wt % to 2 wt % respectively, or (iii) 0.1 wt % to 1 wt % and 0.2 wt % to 1 wt % respectively, or (iv) 0.15 wt % to 0.5 wt % and 0.25 wt % to 0.5 wt % respectively, or (v) 0.2 wt % to 0.4 wt % and 0.2 wt % to 0.4 wt % respectively of the lubricating composition.

In one embodiment the invention provides a method of lubricating an internal combustion engine comprising supplying to the internal combustion engine a lubricating composition as disclosed herein.

In one embodiment the invention provides for the use of the lubricating composition disclosed herein to provide one or more of antiwear performance, friction modifier (particularly for enhancing fuel economy) performance, extreme pressure performance or resistance to corrosion.

In one embodiment the invention provides for the use of the lubricating composition disclosed herein to provide one or more of antiwear performance, friction modifier (particularly for enhancing fuel economy) performance, extreme pressure performance or resistance to corrosion to an internal combustion engine.

In one embodiment the invention provides for the use of the lubricating composition disclosed herein to antiwear performance to an internal combustion engine.

DETAILED DESCRIPTION OF THE INVENTION

The present invention provides a lubricating composition, a method for lubricating an engine as disclosed above, and the use of the lubricating composition as disclosed above.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E-API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Nitrile Compound

In one embodiment the nitrile compound may be obtained/obtainable by a process comprising:

Step (1) reacting:

(i) a carbonyl-containing compound (typically a ketone or aldehyde), with (ii) a compound represented by the formula $N{\equiv}C—CH_2-T$, wherein T may be an electron withdrawing group, for instance $—C{\equiv}N$, $—CO_2R^1$, or $—C(O)NR^2R^3$, $—C(O)SR^4$, typically T may be $—C{\equiv}N$;

$R^1$ may be a hydrocarbyl group, typically containing 1 to 30, or 4 to 20 carbon atoms;

$R^2$ may be hydrogen or a hydrocarbyl group, typically containing 1 to 30, or 4 to 20 carbon atoms;

$R^3$ may be hydrogen or a hydrocarbyl group (typically containing 1 to 30, or 4 to 20 carbon atoms) or hydrogen;

$R^4$ may be hydrogen or a hydrocarbyl group (typically containing 1 to 30, or 4 to 20 carbon atoms) or hydrogen; and Step (2) reacting the product of step (1) with a compound having an abstractable proton (typically a thiol, a primary or secondary amine, or a nitrogen containing heterocylic compound (such as a tetrazole, a pyrrole, a pyrrolidine, a pyrolidinone, a pyridine, an aminopyridine, a piperidine, a pyrazole, a pyrazine, pyridazine, a 1,2,4-triazole, a benzotriazole, a quinoline, an indole, an imidazole), or with a hydrocarbyl halide. Typically step (2) may involve reacting the product of step (1) with a thiol, a tetrazole (such as an aminotetrazole), a 1,2,4-triazole or a benzotriazole (such as tolyltriazole) or an aminotriazole.

In one embodiment the compound having an abstractable proton may be a thiol or a primary or secondary amine, typically a thiol.

In one embodiment the invention provides a lubricating composition comprising an oil of lubricating viscosity and a product obtained/obtainable by a process comprising:

Step (1) reacting:

(i) a carbonyl-containing compound (typically a ketone or aldehyde), with (ii) a compound represented by the formula N≡C—$CH_2$-T, to form a compound of formula (1):

formula (1)

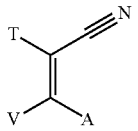

and

Step (2) reacting the compound of formula (1) with a thiol or amine to form a compound of formula (2), formula (3), formula (4), formula (5), or mixtures thereof:

formula (2)

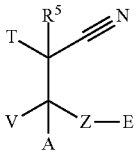

formula (3)

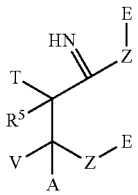

formula (4)

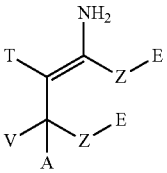

formula (5)

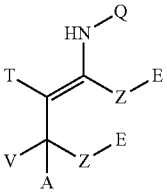

wherein

T may be an electron withdrawing group, for instance —C≡N, —$CO_2R^1$, or —C(O)$NR^2R^3$, —C(O)$SR^4$, —C(S)$R^2R^3$, typically T may be —C≡N; for formulas (3), (4), or (5), T will be —C≡N;

$R^1$ may be a hydrocarbyl group, typically containing 1 to 30, or 4 to 20 carbon atoms;

$R^2$ may be hydrogen, or a hydrocarbyl group, typically containing 1 to 30, or 4 to 20 carbon atoms;

$R^3$ may be hydrogen or a hydrocarbyl group (typically containing 1 to 30, or 4 to 20 carbon atoms);

$R^4$ may be hydrogen or a hydrocarbyl group (typically containing 1 to 30, or 4 to 20 carbon atoms);

$R^5$ may be hydrogen, or a hydrocarbyl group typically containing 1 to 10, or 1 to 5, or 1 to 2 carbon atoms (typically $R^5$ may be hydrogen);

V may be a hydrocarbyl group or hydrogen, or an aromatic group (such as a phenyl, benzyl, or napthyl group). Typically V may be a hydrocarbyl group containing 1 to 30, or 4 to 20 carbon atoms; and A may be a hydrocarbyl group (typically containing 1 to 30, or 4 to 20 carbon atoms) or hydrogen, typically hydrogen;

Z may be —S— or >$NR^4$;

$R^4$ may be hydrogen or a hydrocarbyl group (typically containing 1 to 30, or 4 to 20 carbon atoms), typically $R^4$ may be hydrogen;

E may be a hydrocarbyl group (typically containing 4 to 50, or 4 to 20, or 6 to 12 carbon atoms. The hydrocarbyl group may include alicyclic or cyclic groups (for instance, E may be an alkyl, an aromatic or a heterocyclic group), or a difunctional group; and Q may be either an acyl group such as C(O)$CH_3$, or a hydrocarbyl group, typically containing 1 to 20 carbon atoms, or a benzyl group. The hydrocarbyl group may include alicyclic or cyclic groups (for instance, Q may be an alkyl, an aromatic, or a heterocyclic group) or a difunctional group.

Typically $R^5$ may be hydrogen when the compound of formula (1) is reacted with a thiol.

$R^5$ may be the hydrocarbyl group as defined above when a compound of formula (2) is further reacted with a base (such as triethylamine) followed by alkylation with a $C_{1-10}$-alkylhalide (such as an alkyl iodide), wherein the number of carbon atoms defined for $R^5$ is the same as the number of carbon atoms of the alkylhalide.

The difunctional group may be an alkylene group (typically containing 1 to 20, or 1 to 10, or 1 to 5, or 1 to 3 carbon atoms. Examples of a alkylene bridging group include methylene, ethylene, propylene, butylene or pentylene), or a benzene 1,4-diamino group such as:

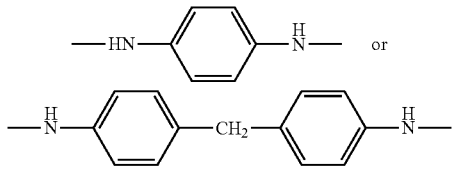

In one embodiment the compound of formula (2) and/or (3) may have a bis-structure represented by formula (2a) and (3a):

formula (2a)

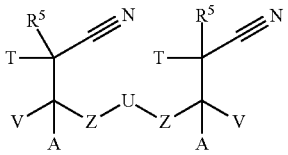

formula (3a)

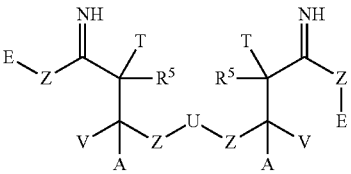

wherein E, Z, T, $R^5$, and Z are the same as defined above, and U may be a difunctional group as described previously within the definition of E.

The compounds of formulae (2a) and/or (3a) may be derived by reacting in step (3) the product of step (2) with a diamino- or dithio-compound, such as 1,2-ethanedithiol, 1,3-propanedithiol, 1,4-butanedithiol, 1,2-diaminoethane, phenylenediamine, 1,4-diaminobutane, or 1,3-diamiopropane or dimercaptothiadiazole.

In one embodiment the invention provides a lubricating composition comprising an oil of lubricating viscosity and at least one compound of formula (2) to formula (5), or mixtures thereof.

In one embodiment the invention provides a lubricating composition comprising an oil of lubricating viscosity and a compound of formula (2) to formula (3), or mixtures thereof.

The nitrile compound described herein by formulae (2) to (5) may be derived from a number of compounds derived from a compound represented by the formula N≡C—$CH_2$-T, wherein T may be —C≡N, —$CO_2R^1$, or —C(O)$NR^2R^3$, —C(O)$SR^4$, typically T may be —C≡N. When T is:

—C≡N, the compound is malononitrile;

—$CO_2R^1$, the compound is a hydrocarbyl-2-cyanoacetate, wherein the hydrocarbyl typically contains 1 to 30, or 4 to 20 carbon atoms;

—C(O)$NR^2R^3$, the compound is a 2-cyano-N,N-dihydrocarbylacetamide when both $R^2$ and $R^3$ are hydrocarbyl group typically containing 1 to 30, or 4 to 20 carbon atoms;

—C(O)$NR^2R^3$, the compound is a 2-cyano-N,N-hydrocarbylacetamide when one of $R^2$ and $R^3$ is hydrogen and the one of either $R^2$ and $R^3$ is a hydrocarbyl group typically containing 1 to 30, or 4 to 20 carbon atoms;

—C(O)$SR^4$, the compound is a S-hydrocarbyl-2-cyanoethanethioate when $R^4$ is a hydrocarbyl group typically containing 1 to 30, or 4 to 20 carbon atoms;

—C(O)$SR^4$, the compound is 2-cyanoethanethioic S-acid, when $R^4$ is hydrogen.

In one embodiment T may be —C≡N.

Examples of hydrocarbyl-2-cyanoacetate include butyl-2-cyanoacetate, hexyl-2-cyanoacetate, 2-ethylhexyl-2-cyanoacetate, octyl-2-cyanoacetate, nonyl-2-cyanoacetate, decyl-2-cyanoacetate, dodecyl-2-cyanoacetate, tridecyl-2-cyanoacetate, butadecyl-2-cyanoacetate, pentadecyl-2-cyanoacetate, hexadecyl-2-cyanoacetate, heptadecyl-2-cyanoacetate, octadecyl-2-cyanoacetate, nonadecyl-2-cyanoacetate, or eicosyl-2-cyanoacetate.

Examples of 2-cyano-N,N-dihydrocarbylacetamide include 2-cyano-N,N-dibutylacetamide, 2-cyano-N,N-dihexylacetamide, 2-cyano-N,N-di-(2-ethylhexyl)-acetamide, 2-cyano-N,N-dinonylacetamide, 2-cyano-N,N-didecylacetamide, 2-cyano-N,N-diundecylacetamide, 2-cyano-N,N-didodecylacetamide, 2-cyano-N,N-ditridecylacetamide, 2-cyano-N,N-dibutadecylacetamide, 2-cyano-N,N-dipentadecylacetamide, 2-cyano-N,N-dihexadecylacetamide, 2-cyano-N,N-diheptadecylacetamide, 2-cyano-N,N-dioctadecylacetamide, 2-cyano-N,N-dinonadecylylacetamide, or 2-cyano-N,N-dieicosylacetamide.

Examples of 2-cyano-N,N-hydrocarbylacetamide include 2-cyano-N,N-butylacetamide, 2-cyano-N,N-hexylacetamide, 2-cyano-N,N-(2-ethylhexyl)-acetamide, 2-cyano-N,N-nonylacetamide, 2-cyano-N,N-decylacetamide, 2-cyano-N,N-undecylacetamide, 2-cyano-N,N-dodecylacetamide, 2-cyano-N,N-tridecylacetamide, 2-cyano-N,N-butadecylacetamide, 2-cyano-N,N-pentadecylacetamide, 2-cyano-N,N-hexadecylacetamide, 2-cyano-N,N-heptadecylacetamide, 2-cyano-N,N-octadecyl-acetamide, 2-cyano-N,N-nonadecylylacetamide, or 2-cyano-N,N-eicosylacetamide.

Examples of S-hydrocarbyl-2-cyanoethanethioate include S-butyl-2-cyanoethanethioate, S-hexyl-2-cyanoethanethioate, S-(2-ethylhexyl)-2-cyanoethanethioate, S-octyl-2-cyanoethanethioate, S-nonyl-2-cyanoethanethioate, S-decyl-2-cyanoethanethioate, S-undecyl-2-cyanoethanethioate, S-dodecyl-2-cyanoethanethioate, S-tridecyl-2-cyanoethanethioate, S-butadecyl-2-cyanoethanethioate, 5-pentadecyl-2-cyanoethanethioate, S-hexadecyl-2-cyanoethanethioate, S-heptadecyl-2-cyanoethanethioate, S-octadecyl-2-cyanoethanethioate, S-nonadecyl-2-cyanoethanethioate, or S-eicosyl-2-cyanoethanethioate.

The carbonyl-containing compound may be a ketone or aldehyde. The carbonyl-containing compound may, in addition to the carbonyl carbon, contain a hydrocarbyl group containing 1 to 30, or 4 to 20 carbon atoms.

Examples of an aldehyde include methanal (formaldehyde), ethanal (acid aldehyde), propanal, butanal, isobutyraldehyde, pentanal, hexanal, heptanal, octanal, 2-ethylhexanal, nonanal, decanal, undecanal, dodecanal, tridecanal, butadecanal, pentadecanal, hexadecanal, heptadecanal, octadecanal, nonadecanal, or eicosanal.

Examples of an aromatic aldehyde include benzaldehyde, or alkyl-substituted benzaldehydes such as 2-methyl benzaldehyde 3-methyl benzaldehyde, 4-methyl benzaldehyde, 2-ethyl benzaldehyde, 3-ethyl benzaldehyde, 4-ethyl benzaldehyde, o-methoxybenzaldehyde, p-methoxybenzaldehyde, m-methoxybenzaldehyde, o-nitrobenzaldehyde, p-nitrobenzaldehyde, m-nitrobenzaldehyde p-chlorobenzaldehyde, salicaldehyde, or mixtures thereof. In one embodiment the aromatic aldehyde may be benzaldehyde.

Examples of a ketone include acetone, acetophenone, cyclohexanone, methyl ethylketone, methyl propyl ketone, methyl isobutyl ketone, butan-2-one, pentan-2-one, pentan-3-one, hexane-2-one, hexan-3-one, heptan-2-one, heptan-3-one, heptan-4-one, or mixtures thereof.

The thiol may be represented by formula $R(—SH)_m$, wherein R may contain 4 to 50, or 4 to 20, or 6 to 12 carbon atoms, and wherein m may be 1 to 10, or 1 to 6, or 1 to 2, or 1. The thiol R group may be a hydrocarbyl group for example alk(en)yl, aryl, or alkaryl (typically alk(en)yl including alkyl). The hydrocarbyl group R may be linear or branched, typically linear. In one embodiment the thiol may be represented by formulae $R(—SH)_m$, wherein m=1 and R is a $C_{6-12}$ linear alkyl group.

The thiol may include nitro-, methoxy-, chloro-, bromo-, or hydrocarbyl-substituted thiophenols, ethanedithiol, benzenethiol, butane-1-thiol, butane-2-thiol, pentane-1-thiol, pentane-2-thiol, hexane-1-thiol, hexane-2-thiol, heptane-1-thiol, heptane-2-thiol, octane-1-thiol, octane-2-thiol, nonane-1-thiol, nonane-2-thiol, nonane-3-thiol, nonane-5-thiol, decane-1-thiol, decane-2-thiol, decane-3-thiol, decane-4-thiol, decane-5-thiol, dodecane-1-thiol (may also be referred to as n-dodecylmercaptan), dodecane-2-thiol, t-nonyl mercaptan, or mixtures thereof.

The nitrile compound may be derived from the reaction described herein in the presence of an amine. The amine has at least one primary or secondary amino-group.

The amine may be a monoamine, a diamine, or a polyamine, typically a monoamine. The amine may contain hydrocarbyl groups that may be alk(en)yl, aryl, or alkaryl. When the hydrocarbyl group contains an alk(en)yl group (or functional moiety) the carbon atoms may be linear or branched.

The monoamine may include a variety of amines having 4 to 30, or 6 to 20, or 8 to 18 carbon atoms. The monoamine may include butylamine, 2-methylpentamine, 2-propylheptamine, 2-butyloctamine, 2-ethylhexylamine, octylamine, nonylamine, isooctylamine, isononylamine, 2-tert-butylheptamine, decylamine, undecylamine, dodecylamine, 2-methyldodecylamine, tridecylamine, tetradecylamine, pentadecylamine, hexadecylamine, 2-methylhexadecylamine, heptadecylamine, octadecylamine, nonadecylamine, eicosylamine, cetyleicosylamine, stearyleicosylamine, docosylamine and/or triacontylamine. Other useful monoamines include oleyl amine, stearyl amine, coco amine, tallow amine, or mixtures thereof.

The primary amine may also include amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of a secondary amine include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amine may include cyclic amines such as piperidine, piperazine, morpholine, aminodiphenylamine, phenylene diamine, or methylene dianiline.

In step (1) the mole ratio of the carbonyl-containing compound to the compound represented by the formula $N{\equiv}C{-}CH_2{-}T$ may be in the range of 5:1 to 1:5, or 2:1 to 1:2, or 1:1. The mole ratio of the product of step (1) to the compound having an abstractable proton may be 5:1 to 1:5, or 2:1 to 1:2, or 1:1 to 1:2.

The reaction to prepare the compound of the present invention may be performed in a variety of different reaction conditions. The reaction may be carried out at a reaction temperature in the range of 15° C. to 100° C., or 15° C. to 80° C., or 15° C. to 60° C. The reaction may be carried out in an inert atmosphere e.g., under nitrogen, or argon, typically nitrogen. The reaction may be performed in the presence or absence of a solvent (typically including a solvent). The solvent includes an aromatic hydrocarbon solvent or alcohol such as ethanol, methanol, propanol, isopropanol, toluene (typically isopropanol). The reaction may be carried out in the absence or presence of catalyst (typically in the presence of a catalyst).

Examples of the catalyst may include triethylamine, β-alanine, pyridine, piperidine, morpholine, piperazine, or ammonium chloride. In one embodiment the catalyst may be triethylamine or β-alanine.

Examples of an aromatic hydrocarbon solvent include Shellsolv AB® (commercially available from Shell Chemical Company); and toluene extract, Aromatic 200, Aromatic 150, Aromatic 100, Solvesso 200, Solvesso 150, Solvesso 100, HAN 857® (all commercially available from Exxon Chemical Company), or mixtures thereof. Other aromatic hydrocarbon solvents include xylene, toluene, or mixtures thereof.

In one embodiment the nitrile compound represented by formula (6):

formula (6)

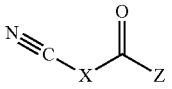

wherein

X may be a linear or branched hydrocarbylene group, or a heteroatom-containing hydrocarbylene group (such as $-CH_2-O-CH_2-$, or $-CH_2CH_2-O-CH_2CH_2-$, or $-C(CH_3)H-OCH_2-$ or $-C(CH_3)HCH_2-O-CH_2CH_2-$, (typically X may be a linear or branched hydrocarbylene group);

Z may be $-OR^6$, $-NR^6R^7$, a hydrocarbyl group (such as alkyl, aryl, or alkaryl), or $-S-R^6$, (typically z may be $-OR$, $-NR^6R^7$);

$R^6$ may be a linear or branched hydrocarbyl group (typically the hydrocarbyl group may contain 4 to 40, or 6 to 30, or 8 to 20 carbon atoms), an alkoxy group or an aryloxy group; and $R^7$ may be hydrogen, or a linear or branched hydrocarbyl group (typically the hydrocarbyl group may contain 4 to 40, or 6 to 30, or 8 to 20 carbon atoms), an alkoxy group or an aryloxy group.

The nitrile compound may be derived from a cyano-substituted carboxylic acid. The cyano-substituted carboxylic acid may include a number of acids. The acids may include classes of compounds such as a cyano-alkanoic acid, a cyano-alkenoic acid, a carbonic acid mono-(cyano-alkyl) ester, a thiocarbonic acid S-cyanoalkyl ester, or mixtures thereof. In one embodiment the cyano-substituted carboxylic acid may be a cyano-alkanoic acid, or mixtures thereof.

The cyano-alkanoic acid may include cyanoethanoic acid, 2-cyanopropanoic acid, 3-cyanopropanoic acid, 2-cyanobutanoic acid, 3-cyanobutanoic acid, 4-cyanobutanoic acid, 2-cyanopentanoic acid, 3-cyanopentanoic acid, 4-cyanopentanoic acid, 5-cyanopentanoic acid, or mixtures thereof. In one embodiment the cyano-substituted carboxylic acid may be cyanoethanoic acid.

The carbonic acid mono-(cyano-alkyl) ester may include carbonic acid mono-(2-cyano-ethyl) ester, carbonic acid mono-(2-cyano-propyl) ester, carbonic acid mono-(3-cyano-propyl) ester, carbonic acid mono-(2-cyano-butyl) ester, carbonic acid mono-(3-cyano-butyl) ester, carbonic acid mono-(4-cyano-butyl) ester, carbonic acid mono-(2-cyano-pentyl) ester, carbonic acid mono-(3-cyano-pentyl) ester, carbonic acid mono-(4-cyano-pentyl) ester, carbonic acid mono-(5-cyano-pentyl) ester, or mixtures thereof.

The thiocarbonic acid S-cyanoalkyl ester may include thiocarbonic acid S-cyanomethyl ester, thiocarbonic acid S-cyanoethyl ester, thiocarbonic acid S-cyanopropyl ester, thiocarbonic acid S-cyanobutyl ester, thiocarbonic acid S-cyanopentyl ester or mixtures thereof.

The cyano-alkenoic acid may include 2-cyanopropenoic acid, 3-cyanopropenoic acid, 2-cyanobutenoic acid, 3-cyanobutenoic acid, 4-cyanobutenoic acid, 3-cyano-but-3-enoic acid, 4-cyano-but-3-enoic acid, 2-cyanopentenoic acid, 3-cyanopentenoic acid, 4-cyanopentenoic acid, 3-cyano-pent-3-enoic acid, 4-cyanopent-3-enoic acid, or mixtures thereof.

The aromatic solvent useful for preparing the thiol, monoamine of formula (6) may be the same as described above.

The nitrile compound may be derived from the reaction of the cyano-substituted carboxylic acid with an alkoxy alcohol, or an aryloxy alcohol. The alkoxy alcohol or aryloxy (typically phenoxy) may derived from oleyl ethoxylate, lauryl ethoxylate, stearyl ethoxylate, coco ethoxylate, tallow ethoxylate, oleyl propoxylate, lauryl propoxylate, stearyl propoxylate, coco propoxylate, tallow propoxylate, phenyl ethoxylate, tert-butyl phenyl ethoxylate, tert-butyl phenyl propoxylate, or mixtures thereof.

The nitrile compound may be derived from the reaction of the cyano-substituted carboxylic acid with an amine. The amine may be a monoamine, a diamine, or a polyamine, aminoalcohol, typically a monoamine or aminoalcohol. The amine may contain hydrocarbyl groups that may be alk(en)yl, aryl, or alkaryl. When the hydrocarbyl group contains an alk(en)yl group (or functional moiety) the carbon atoms may be linear or branched.

The nitrile compound may be derived from the reaction of the cyano-substituted carboxylic acid with an aminoalcohol. The aminoalcohol may include ethanolamine, isopropanolamine, diethanolamine, triethanolamine, diethylethanolamine, dimethylethanolamine, dibutylethanolamine, 3-amino-1,2-propanediol; serinol; 2-amino-2-methyl-1,3-propanediol; tris(hydroxymethyl)-aminomethane; N-methylglucamine, 1-amino-1-deoxy-D-sorbitol; diethanol amine; diisopropanolamine; N-methyl-N,N-diethanolamine; triethanolamine; N,N,N',N'-tetrakis(2-hydroxypropyl)ethylenediamine, 2-amino-2-methyl-1-propanol, 2-dimethylamino-methyl-1-propanediol, 2-amino-2-ethyl-1,3-propanediol, 2-amino-2-methyl-1,3-propanediol, 2-amino-1-butanol and mixtures thereof. In one embodiment the aminoalcohol may be ethanolamine, or diethanolamine.

The nitrile compounds disclosed herein may be prepared by a process comprising reacting a cyano-substituted carboxylic acid with a compound selected from the group consisting of an alcohol, a thiol, an amine and an aminoalcohol.

In one embodiment the nitrile compounds disclosed herein may be prepared by a process comprising reacting a cyano-substituted carboxylic acid with a compound selected from the group consisting of an alcohol, and an amine.

The mole ratio of cyano-substituted carboxylic acid to any one of the alcohol, the amine or the aminoalcohol may range from 5:1 to 1:5, or 2:1 to 1:2, or 1:1.

The reaction to prepare the compound of the present invention may be performed in a variety of different reaction conditions. The reaction may be carried out at a reaction temperature in the range of 70° C. to 200° C., or 90° C. to 180° C., or 100° C. to 160° C. The reaction may be carried out in an inert atmosphere e.g., under nitrogen, or argon, typically nitrogen. The reaction may be performed in the presence or absence of a solvent (typically including a solvent). The solvent includes an aromatic hydrocarbon solvent. The reaction may be carried out in the absence or presence of catalyst (typically in the presence of a catalyst). The catalyst may be a sulphonic acid, such as methane sulphonic acid, toluene sulphonic acid, benzene sulphonic acid, or $C_{12}H_{25}$-alkyl sulphonic acid. The catalyst may also include metal salts of titanium, zirconium or aluminium that have counterions of chloride, bromide, iodide, or alkoxides (wherein alkyl group on the alkoxide may have 1 to 20, or 1 to 4 carbon atoms), or mixtures thereof. The catalyst may also include a phosphoric acid of formula HO—(P(O)(OH)O)$_e$—H, where e may be 1 to 5, or 2 to 5. In one embodiment the catalyst may be a sulphonic acid, typically methane sulphonic acid.

In one embodiment the nitrile may be a saturated or unsaturated hydrocarbon compound containing one or more cyano groups. The nitrile may have general formula $CH_3(CQW)_m$—C≡N, wherein m may be 2 to 50, or 5 to 30, 6 to 30, or 7 to 22, or 8 to 18, or 10 to 18, or 11 to 14, or 11 to 13, and Q and W may independently be a hydrocarbon group (typically containing 1 to 20, or 1 to 10, or 2 to 8 carbon atoms), or hydrogen. In one embodiment Q and W are both hydrogen.

The nitrile of formula $CH_3(CQW)_m$—C≡N may be branched or linear, saturated or unsaturated.

In one embodiment the nitrile of formula $CH_3(CQW)_m$—C≡N may be branched or linear, with the proviso that when m is 14 or more, the fatty nitrile contains one or more alkenyl groups and/or one or more tertiary carbon atoms.

Examples of a nitrile compound of formula $CH_3(CQW)_m$—C≡N include dodecylnitrile, stearylnitrile, oleylnitrile, decylnitrile, tallow nitrile, mixed-nitrile derivatives of linseed oil, or mixtures thereof.

In one embodiment a nitrile compound of formula $CH_3(CQW)_m$—C≡N may include dodecylnitrile, stearylnitrile, oleylnitrile, decylnitrile, tallow nitrile, mixed-nitrile derivatives of linseed oil, or mixtures thereof.

The nitrile compound of formula $CH_3(CQW)_m$—C≡N may be obtained from Akzo Nobel under the tradename Arneel®12 (also known under the trademark ARNEEL®C), Arneel®M, Arneel®O, Arneel®T and Arneel®10D. Arneel®T is tallow nitrile, Arneel®M is a mixture of $C_{16-22}$ nitriles, Arneel®10D is decanenitrile, Arneel®O is oleylnitrile, and Arneel®12 is a mixture of $C_{10}$, $C_{12}$, $C_{14}$ and $C_{16}$ saturated nitriles.

In one embodiment the nitrile of the invention may be of formula $CH_3(CQW)_m$—C≡N.

The nitrile compound the nitrile compound may be present at 0.01 wt % to 5 wt %, or 0.1 wt % to 3 wt %, or 0.2 wt % to 1.5 wt % of the lubricating composition.

Compound Derived from Hydroxy-Carboxylic Acid

The invention provides a lubricating composition containing a compound which is a derivative of a hydroxy-carboxylic acid. The compound which is a derivative of a hydroxy-carboxylic acid may be represented by the formula (7):

formula (7)

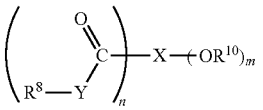

wherein n and m may be independently integers of 1 to 5;

$X^1$ may be an aliphatic or alicyclic group, or an aliphatic or alicyclic group containing an oxygen atom in the chain, or a substituent group of the foregoing types, said group containing up to 6 carbon atoms and having n+m available points of attachment; each Y may be independently —O—, >NH, or >$NR^9$ or two Ys together representing the nitrogen of an imide structure $R^8$—N< formed between two carbonyl groups; and each $R^8$ and $R^9$ may be independently hydrogen or a hydrocarbyl group, provided that at least one $R^8$ or $R^9$ group is a hydrocarbyl group; each $R^{10}$ may be independently hydrogen, a hydrocarbyl group or an acyl group, further provided that at least one —$OR^{10}$ group is located on a carbon atom within X that is α or β to at least one of the —C(O)—Y—$R^8$ groups.

The compound derived from the hydroxy-carboxylic acid may be derived from glycolic acid (n and m both equal 1), malic acid (n=2, m=1), tartaric acid (n and m both equal 2), citric acid (n=3, m=1), or mixtures thereof. In one embodiment the compound derived from the hydroxy-carboxylic acid may be derived from tartaric acid.

The compound derived from the hydroxy-carboxylic acid may be an amide, ester or imide derivative of a hydroxy-carboxylic acid, or mixtures thereof. In one embodiment the compound derived from the hydroxy-carboxylic acid may be an amide, ester or imide derivative of a hydroxy-carboxylic acid, for example an ester or imide of tartaric acid. In one embodiment the compound derived from the hydroxy-carboxylic acid may be an ester derivative of a hydroxy-carboxylic acid.

In one embodiment the compound derived from the hydroxy-carboxylic acid may be at least one of a hydroxy-carboxylic acid di-ester, a hydroxy-carboxylic acid di-amide, a hydroxy-carboxylic acid di-imide, a hydroxy-carboxylic acid mono-imide, a hydroxy-carboxylic acid ester-amide, a hydroxy-carboxylic acid ester-imide, and a hydroxy-carboxylic acid imide-amide. In one embodiment the amide, ester or imide derivative of a hydroxy-carboxylic acid may derived from at least one of the group consisting of a hydroxy-carboxylic acid di-ester, a hydroxy-carboxylic acid di-amide, a hydroxy-carboxylic acid mono-imide, and a hydroxy-carboxylic acid ester-amide.

Each $R^8$, $R^9$ and $R^{10}$ group of the compound derived from the hydroxy-carboxylic acid may be linear or branched alkyl groups, each having 1 to 150, or 8 to 30, or 8 to 20 carbon atoms. The ester derivatives of the hydroxy-carboxylic acid may be formed by the reaction of an alcohol with hydroxy-carboxylic acid. The alcohol includes both monohydric alcohol and polyhydric alcohol. The carbon atoms of the alcohol may be linear chains, branched chains, or mixtures thereof.

Examples of a suitable branched alcohol include 2-ethylhexanol, iso-tridecanol, iso-octyl, Guerbet alcohols, or mixtures thereof.

Examples of a monohydric alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 8 to 20 carbon atoms.

In one embodiment the imide derivatives of a hydroxy-carboxylic acid may be tartrimides, typically containing 8 to 20 carbon atoms. Amines used to prepare imides may include alkyl amines (such as n-hexylamine (caproylamine), n-octylamine (caprylylamine), n-decylamine (1-aminodecane), n-dodecylamine (laurylamine), n-tetradecylamine (myristylamine), n-pentadecylamine, n-hexadecylamine (palmitylamine), margarylamine, n-octadecylamine (stearylamine)), unsaturated amines (such as dodecenylamine, myristoleylamine, palmitoleylamine, oleylamine, and linoleylamine), or etheramines (such as those identified as SURFAM™ P14AB (branched C14), SURFAM™ PA-16 (linear C16), and SURFAM™ P17AB (branched C17)). A detailed description of methods for preparing suitable tartrimides (by reacting tartaric acid with a primary amine) is disclosed in U.S. Pat. No. 4,237,022.

PCT Patent Applications WO 2008/147700 and WO 2008/147704 disclose in more detail useful hydroxycarboxylic acid compounds for the present invention.

Canadian Patent 1 183 125; U.S. Patent Publication numbers 2006/0183647 and 2006/0079413; PCT publication WO 2008/067259; and British Patent 2 105 743 A, all disclose useful examples of suitable tartaric acid derivatives.

The compound derived from the hydroxy-carboxylic acid may be present at 0.01 wt % to 5 wt %, or 0.1 wt % to 3 wt %, or 0.2 wt % to 1.5 wt %, or 0.25 wt % to 1 wt %, or 0.5 wt % to 1 wt % of the lubricating composition.

Other Performance Additives

The lubricating composition optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent, a dispersant viscosity modifier, a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be an N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the friction modifier may be selected from the group consisting of long chain fatty acid derivatives of amines, long chain fatty esters, long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, saligenins, salicylates, and mixtures thereof.

The overbased detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be a sodium, calcium or magnesium salt of the phenates, sulphur containing phenates, sulphonates, salixarates, saligenins, and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of U.S. Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. Overbased detergents are known in the art. The overbased detergent may be present at 0 wt % to 15 wt %, or 0.1 wt % to 10 wt %, or 0.2 wt % to 8 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, fatty esters, or fatty epoxides other than the hydroxy-carboxylic acid derivatives of this invention.

In one embodiment the friction modifier may be a long chain fatty acid ester. In another embodiment the long chain fatty acid ester may be a mono-ester and in another embodiment the long chain fatty acid ester may be a (tri)glyceride.

Other performance additives such as corrosion inhibitors include those described in paragraphs 5 to 8 of PCT Application US05/038319, published as WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including polysiloxanes or copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Compound[1] | 0.05 to 2 | 0.1 to 1 | 0.15 to 0.5 |
| Nitrile Compound | 0.05 to 2 | 0.1 to 1 | 0.15 to 0.5 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 10 | 0.1 to 5 | 0.3 to 2 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100 % | Balance to 100 % | Balance to 100 % |

Footnote:
[1]Compound is described above as a compound which is a derivative of a hydroxycarboxylic acid.

INDUSTRIAL APPLICATION

The lubricating composition may be utilised in an internal combustion engine. The engine components may have a surface of steel or aluminium (typically a surface of steel).

An aluminium surface may be derived from an aluminium alloy that may be a eutectic or hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash content of 1.5 wt % or less.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

As used herein the term "hydrocarbylene" is used in a similar way as hydrocarbyl, except where the hydrocarbyl group has a carbon atom directly attached to the remainder of the molecule e.g., an alkyl group. In contrast, a hydrocarbylene group is attached to two or more additional atoms within the molecule e.g., an alkylene group (i.e., —$CH_2CH_2CH_2$—).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising 0.1 to 1.5 wt % of a nitrile compound wherein said nitrile compound is (i) a hydrocarbyl-2-cyanoacetate, (ii) a 2-cyano-N,N-dihydrocarbylacetamide, (iii) a S-hydrocarbyl-2-cyanoethanethioate, (iv) a 2-cyanoethanethioic S-acid, or (v) a compound derived from the reaction of a cyano-substituted carboxylic acid with an alcohol, a thiol, an amine or an aminoalcohol;

0.05 to 2 wt % of a compound which is a derivative of a hydroxy-carboxylic acid, represented by the formula:

formula (7)

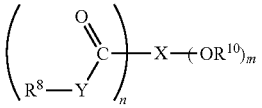

wherein n and m are independently integers of 1 to 5;

X is an aliphatic or alicyclic group, or an aliphatic or alicyclic group containing an oxygen atom in the chain, or a substituent group of the foregoing types, said group containing up to 6 carbon atoms and having n+m available points of attachment;

each Y is independently —O—, >NH, or >$NR^9$ or two Ys together represent the nitrogen of an imide structure $R^8$—N< formed between two carbonyl groups; and each $R^8$ and $R^9$ are independently hydrogen or a hydrocarbyl group, provided that at least one $R^8$ or $R^9$ group is a hydrocarbyl group; each $R^{10}$ is independently hydrogen, a hydrocarbyl group or an acyl group, further provided that at least one —$OR^{10}$ group is located on a carbon atom within X that is α or β to at least one of the —C(O)—Y—$R^8$ groups, said compound being such a derivative of glycolic acid, malic acid, tartaric acid, or citric acid, 0.05 to 12 wt % of dispersant, 0 to 5 wt % of a dispersant viscosity modifier, 0 to 15 wt % of overbased detergent, 0 to 15 wt % of antioxidant, 0 to 10 wt % antiwear agent, 0 to 10 wt % viscosity modifier, 0 to 10 wt % of at least one of metal deactivators, corrosion inhibitors, extreme pressure agents, foam inhibitors, demulsifiers, pour point depressants, seal swelling agents and mixtures thereof, 0 wt % friction modifier, balance to 100% of an oil of lubricating viscosity, wherein the lubricating composition is characterized as having a phosphorus content of 200 ppm to 600 ppm.

2. The lubricating composition of claim 1, wherein the hydroxy-carboxylic acid is a derivative of tartaric acid, or mixtures thereof.

3. The lubricating composition of claim 1, wherein the nitrile and the compound which is a derivative of a hydroxy-carboxylic acid are present in amounts in the range of 0.2 wt % to 0.4 wt % and 0.2 wt % to 0.4 wt %, respectively, of the lubricating composition.

4. The lubricating composition of claim 1, wherein the lubricating composition is characterized as having (i) a sulphur content of 0.5 wt % or less, (ii) a phosphorus content of 200 ppm to 600 ppm, and (iii) a sulphated ash content of 1.5 wt % or less.

5. The lubricating composition of claim 1, further comprising an overbased detergent, wherein the overbased detergent is selected from the group consisting of phenates, sulphur-containing phenates, sulphonates, salixarates, salicylates, and mixtures thereof.

6. A method of lubricating an internal combustion engine comprising supplying to the internal combustion engine the lubricating composition of claim 1.

7. The method of claim 6, wherein the internal combustion engine has a cylinder bore, cylinder block, or piston ring having a steel surface.

8. The lubricating composition of claim 1, wherein the lubricating composition comprises 0.15 to 0.5 wt % of said nitrile compound; and 0.15 to 0.5 wt % of said derivative of a hydroxy-carboxylic acid;

0.5 to 6 wt % of dispersant, 0.02 to 2 wt % of a dispersant viscosity modifier, 0.2 to 8 wt % of overbased detergent, 0.5 to 5 wt % of antioxidant, 0.3 to 2 wt % antiwear agent, 1 to 6 wt % viscosity modifier, 0 to 6 wt % of at least one of metal deactivators, corrosion inhibitors, extreme pressure agents, foam inhibitors, demulsifiers, pour point depressants, seal swelling agents and mixtures thereof, 0 wt % friction modifier, and balance to 100% of an oil of lubricating viscosity.

9. The lubricating composition of claim 8, wherein the antiwear agent is zinc dialkyldithiophosphate.

10. The lubricating composition of claim 9, wherein the zinc dialkyldithiophosphate is present at 0.5 to 0.9 wt % of the lubricating composition.

11. The lubricating composition of claim 1 wherein the derivative of hydroxycarboxylic acid comprises oleyl tartrimide or a dialkyltartrate the alkyl groups thereof comprising 8 to 20 carbon atoms.

* * * * *